US008272475B2

(12) United States Patent
Helenius et al.

(10) Patent No.: US 8,272,475 B2
(45) Date of Patent: Sep. 25, 2012

(54) SOUND ATTENUATOR FOR LOW FREQUENCIES, METHOD FOR MANUFACTURING SOUND ATTENUATOR FOR LOW FREQUENCIES AND SYSTEM FOR ATTENUATING LOW FREQUENCIES FOR EXAMPLE IN AIR-CONDITIONING DUCTS OF PAPER MILLS

(75) Inventors: Kalle Helenius, Lieto As. (FI); Henrik Pettersson, Mynämäki (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 12/990,185

(22) PCT Filed: Apr. 28, 2009

(86) PCT No.: PCT/FI2009/050334

§ 371 (c)(1), (2), (4) Date: Nov. 24, 2010

(87) PCT Pub. No.: WO2009/133240

PCT Pub. Date: Nov. 5, 2009

(65) Prior Publication Data

US 2011/0061968 A1 Mar. 17, 2011

(30) Foreign Application Priority Data

Apr. 30, 2008 (FI) ..... 20085397

(51) Int. Cl.

| | |
|---|---|
| ***E04F 17/04*** | (2006.01) |
| ***E04B 1/86*** | (2006.01) |
| ***E04B 1/84*** | (2006.01) |
| ***E04B 1/82*** | (2006.01) |
| *E04B 1/74* | (2006.01) |

(52) U.S. Cl. ..... 181/224; 181/287; 181/290; 454/262; 454/206; 454/346; 454/351; 454/352; 454/906

(58) Field of Classification Search ..... 181/224, 181/225, 226, 284, 287, 290, 292, 295; 454/262, 454/906, 206, 346–348, 351, 352
See application file for complete search history.

(56) References Cited

U.S. PATENT DOCUMENTS 2,989,136 A * 6/1961 Wohlberg ..... 181/224
(Continued)

FOREIGN PATENT DOCUMENTS

DE 28 25 939 1/1980
(Continued)

OTHER PUBLICATIONS

Das Papier, Heft 5, 1992: "Neuartige Membran-Schalldämpfer an Vakuumanlagen von Papiermaschinen" (A new type of membrane silencer in vacuum systems of paper machines).

(Continued)

*Primary Examiner* — Edgardo San Martin
(74) *Attorney, Agent, or Firm* — Cozen O'Connor

(57) ABSTRACT

A sound attenuator for low frequencies in an air-conditioning duct of paper mills includes a sound attenuator frame insertable in the air-conditioning duct. At least one attenuator member operating according to the plate resonator principle has a first resonator plate, a framework, whereto the first resonator plate is attached by its inner surface, and a second plate, which is essentially parallel to the first resonator plate. The second plate is attached to the framework by its inner surface, whereby the second plate, the framework and the first resonator plate delimit at least one attenuator unit. The first resonator plate, attached to the framework, is a steel plate and is attached to the framework by laser welding and the framework comprises a pressure balancing opening.

23 Claims, 5 Drawing Sheets

U.S. PATENT DOCUMENTS

| | | | | | |
|---|---|---|---|---|---|
| 3,175,640 | A | | 3/1965 | Matsui | |
| 3,604,530 | A | * | 9/1971 | Duthion et al. | 181/210 |
| 3,738,448 | A | * | 6/1973 | Ver et al. | 181/252 |
| 3,983,955 | A | * | 10/1976 | Vasiljevic | 181/285 |
| 4,109,754 | A | | 8/1978 | Purhonen | |
| 4,236,597 | A | * | 12/1980 | Kiss et al. | 181/224 |
| 4,276,954 | A | * | 7/1981 | Romano | 181/224 |
| 4,287,962 | A | | 9/1981 | Ingard et al. | |
| 4,316,522 | A | * | 2/1982 | Hirschorn | 181/224 |
| 4,330,047 | A | * | 5/1982 | Ruspa et al. | 181/224 |
| 4,336,863 | A | | 6/1982 | Satomi | |
| 4,378,859 | A | | 4/1983 | Satomi | |
| 4,787,473 | A | * | 11/1988 | Fuchs et al. | 181/224 |
| 4,899,846 | A | * | 2/1990 | Furuta et al. | 181/210 |
| 5,260,523 | A | | 11/1993 | Pettersson et al. | |
| 5,268,541 | A | | 12/1993 | Pettersson | |
| 5,276,291 | A | | 1/1994 | Norris | |
| 5,625,172 | A | | 4/1997 | Blichmann et al. | |
| 5,728,980 | A | * | 3/1998 | Zarnick | 181/224 |
| 5,869,792 | A | | 2/1999 | Allen et al. | |
| 5,975,238 | A | | 11/1999 | Fuchs et al. | |
| 6,116,375 | A | | 9/2000 | Lorch et al. | |
| 6,530,452 | B1 | | 3/2003 | Pettersson et al. | |
| 6,581,722 | B2 | | 6/2003 | Faulhaber et al. | |
| 6,814,182 | B2 | | 11/2004 | Dausch | |
| 7,258,196 | B2 | | 8/2007 | Radatus et al. | |
| 7,581,619 | B1 | * | 9/2009 | Storm | 181/225 |
| 2007/0062756 | A1 | | 3/2007 | Seibt et al. | |

FOREIGN PATENT DOCUMENTS

| | | |
|---|---|---|
| DE | 33 22 204 | 1/1985 |
| DE | 33 30 471 | 3/1985 |
| DE | 39 35 350 | 4/1991 |
| DE | 44 35 296 | 4/1996 |
| DE | 195 06 511 | 8/1996 |
| DE | 197 51 596 | 6/1999 |
| DE | 20 2004 021 451 | 4/2008 |
| EP | 0 265 000 | 4/1988 |
| EP | 0 487 481 | 5/1992 |
| EP | 0 495 763 | 7/1992 |
| EP | 0 638 755 | 2/1995 |
| EP | 0 723 123 | 7/1996 |
| FI | 56584 | 10/1979 |
| GB | 1 350 683 | 4/1974 |
| GB | 1 556 823 | 10/1979 |
| GB | 2 122 256 | 1/1984 |
| GB | 2 243 187 | 10/1991 |
| SE | 531 118 | 12/2008 |
| SE | 531 124 | 12/2008 |
| WO | WO 89/08215 | 9/1989 |

OTHER PUBLICATIONS

HLH Bd. 39 (1988): "Schalldämpfer im Luftkanal" (Silencer in an air duct).

Schako advertisement: "Membran-Absorber" (Membrane absorber).

Two papers, Fraunhofer Institut für Bauphysik, Stuttgart, Germany, 1992: "Resonanz- und Dämpfungsmechanismen in Membran-Absorbern" (Resonance and attenuation mechanisms in membrane absorbers), "Erfahrungen beim Einsatz von Membran-Absorbern für spezielle Anforderungen" (Experiences from application of membrane absorbers for special requirements).

Wochenblatt für Papierfabrikation 19, 2006: "Plattenabsorber gegen Schall und Rauch" (Plate absorber against sound and smoke).

* cited by examiner

SOUND ATTENUATOR FOR LOW FREQUENCIES, METHOD FOR MANUFACTURING SOUND ATTENUATOR FOR LOW FREQUENCIES AND SYSTEM FOR ATTENUATING LOW FREQUENCIES FOR EXAMPLE IN AIR-CONDITIONING DUCTS OF PAPER MILLS

The object of the invention is a sound attenuator for low frequencies, a method for manufacturing a sound attenuator for low frequencies and a system for attenuating low frequencies for example in air-conditioning ducts of paper mills according to what is presented in the preambles of the independent claims presented below.

PRIOR ART

In a factory environment, for example in paper mills, various fans and vacuum pumps cause noise problems. From the factory, the noise is carried out into the immediate surroundings via air-conditioning ducts. Objectives regarding environmental protection and the comfort of the areas near the factory create a need for reducing the noise problems. Various types of attenuation solutions are used in noise control. Attenuators which have traditionally been used in paper mills, operating by the absorption principle, typically attenuate the higher 500-4000 Hz frequency components of the noise. With the new-type, so-called reactive attenuators also lower frequencies can be attenuated and thus the noise problems caused by the paper mills to the surroundings can be remarkably reduced.

In traditional absorption attenuators a part of the acoustic energy is absorbed into the porous material arranged inside the air-conditioning duct and is transformed into thermal energy. The effect of the reactive sound attenuators is based, through the geometric properties of the attenuator structure, either on reflection of sound waves or on the resonance phenomenon. Examples of attenuator types based on resonance are a pipe resonator, a Helmholtz resonator and a plate resonator.

The operation of a plate resonator attenuator is based on the transformation of sound energy into heat with the aid of a resonating acoustic system. The resonator consists of a nonporous plate or film, which separates the airspace from the sound field on the outside. Part of the sound energy is transformed into kinetic energy of the nonporous plate and through it into kinetic energy of the molecules of the airspace and into heat. There may also be an absorptive material, such as for example Dacron™, wool or foam plastic in the airspace. A maximal sound attenuation is obtained at the so-called resonant frequency, which can be determined by calculation when the depth of the airspace and the surface weight of the film or plate are known. The plate resonator differs from the Helmholtz-type resonator especially because there is an opening on the plate surface of the Helmholtz resonator, in which opening the vibrations of the formed air plug and chamber air provide the attenuation. The resonant frequency of the system, i.e. the frequency which corresponds to the maximal attenuation, also depends on the surface area of the opening and the length of the air plug formed in the opening.

The exhaust air from paper machines contains various impurities and in some cases also large amounts of moisture. Especially traditional absorptive attenuators are prone to fouling and the fouling of porous materials significantly weakens the attenuation. Servicing—cleaning or changing of the absorption attenuator is typically difficult. Of the reactive attenuators especially the Helmholtz resonators are prone to fouling and sometimes it is necessary to use a special protective film in front of the actual perforated resonant film. An advantage especially of the plate resonator is that fouling does not weaken the attenuation but transfers the attenuation to lower frequencies. Some plate resonator attenuator solutions have however turned out to be too fragile in a factory environment. The challenge has turned out to be providing a sufficient attenuation with solutions, which withstand factory conditions.

Many different materials have been tried for the materials of the sound attenuator frame and the plate of the plate resonator attenuator. Heat expansion has a harmful effect in solutions, where different materials have been combined, for examples when combining a steel framework with a plastic plate or an aluminium plate. The heat expansion affects the plastic plate or the aluminium plate and the steel framework in a different way, which leads to an alteration in the resonant frequency of the attenuator and thus in the attenuated frequency range.

The plate of the plate resonator is typically attached to the framework of the attenuator for example by screwing or welding. The large thermal stresses caused by the welding methods may however cause harmful changes in the shape of the plate or framework. The obtained seams have not necessarily been tight enough to provide a satisfactory attenuator structure.

One sound attenuator solution is presented in publication U.S. Pat. No. 5,268,541.

OBJECT AND DESCRIPTION OF THE INVENTION

It is an object of the present invention to reduce or even eliminate the above-mentioned problems appearing in the prior art.

It is an object of the present invention to provide a solution, with which the noise of air-conditioning ducts and the like can be reduced for example in paper mills.

It is another object of the present invention to provide a solution, with which a sufficient attenuation is provided with a durable sound attenuator structure.

It is further an object of the present invention to provide a solution, wherein, by selecting the materials and dimensions correctly, attenuation is provided for just the suitable frequency range.

It is further an object of the present invention to provide a solution, where the sound attenuator can withstand high temperatures while the resonant frequency remains constant.

It is an object of the present invention to provide a sound attenuator, which is easy to clean.

The embodiments and advantages mentioned in this text relate, where applicable, both to the device, the method as well as to the system according to the invention, even though it is not always specifically mentioned.

A typical sound attenuator according to the invention can be arranged in any environment, where sound attenuation is appropriate, for example in a paper, pulp or paperboard mill. The sound attenuator can be arranged in connection with a structure, which is meant for transferring air from one space to another, for example an air-conditioning or ventilation duct, whereby the flow, which travels in the duct, can be arranged to pass through the sound attenuator. A typical sound attenuator according to the invention comprises a sound attenuator frame, which can be arranged for example in connection with an air-conditioning duct. The frame can be lined for example with mineral wool, foam plastic or Dacron™. The thickness of the insulating layer is typically 50-200 mm. The height of an individual attenuator frame is preferably between 500-3500 mm, for example about 1200, 1700 or 2200 mm. The width of the attenuator frame is preferably between 500-3500 mm, for example about 1400 mm, 2200 mm or 2400 mm. The depth of the attenuator frame is preferably between 500-5000 mm, for example about 1600 mm, 1800 mm, 2000 mm, 2200 mm or 2500 mm.

A typical attenuator member according to the invention comprises a first resonator plate, the outer surface of which is arranged to be the inner wall of the flow duct, along which outer surface the flow is arranged to travel. A typical attenuator member according to the invention also comprises a framework, whereto the first resonator plate is attached by its inner surface. A typical attenuator member according to the invention also comprises a second plate, which is essentially parallel to the first resonator plate and which second plate is attached to the framework by its inner surface, whereby the second plate, the framework and the first resonator plate delimit at least one attenuator unit. The airspace left between the framework and the plates can, if needed, be filled with an insulating material, such as mineral wool, foam plastic or Dacron™.

The first resonator plate attached to the framework of a typical sound attenuator according to the invention is a steel plate. In a typical solution according to the invention the first resonator plate is attached to the framework using laser welding. The advantages of laser welding are a high welding speed, a deep and narrow welding seam, good reproducibility and a small heat zone, whereby the risk of the framework or plate changing shape due to the heat is reduced. The framework of a typical sound attenuator according to the invention comprises a pressure balancing opening, with the aid of which the overpressure arising in the chamber formed by the framework and the plates for example during welding can be reduced. The pressure balancing opening usually leads from inside the framework to the outside of the attenuator member. The pressure balancing opening can for example be a valve, an aperture or a circular aperture on one of the plates of the framework. The size of the opening is preferably between 5-20 mm. The size of the circular aperture can for example be about 10 mm. The pressure balancing opening can also be a break in the welding seam. With the aid of the pressure balancing openings or the broken welding seams, also the pressure differences arising during the use of the attenuators can be reduced.

In this application resonator plate is used to mean a plate, which can be made to vibrate at a certain inherent frequency. In this application framework is used to mean a structure, which forms at least one essential rectangle and which can, when needed, be divided into parts, so that several essential rectangles are formed. The framework is formed out of a plate, the thickness of which is preferably 0.5-3 mm, for example 0.8-1.5 mm.

In a typical sound attenuator according to the invention at least one attenuator member, which operates according to the plate resonator principle, has been arranged in a detachable manner in connection with the air-conditioning duct and the sound attenuator frame. Between the attenuator member and the sound attenuator frame can be arranged for example a rail member.

In an advantageous embodiment of the present invention the framework of the sound attenuator comprises at least four essentially rectangular plates. In an advantageous embodiment of the present invention the framework is divided with the aid of several horizontal and vertical essentially rectangular plates in such a way that several essential rectangles are formed in the framework.

In an advantageous embodiment of the present invention the framework is at least mainly made up of plates, which are at least mainly perpendicular to the first resonator plate.

In an advantageous embodiment of the present invention both the attenuator member and the sound attenuator frame are mainly rectangular prisms.

In an advantageous embodiment of the present invention the attenuator units are mainly rectangular prisms.

In an advantageous device according to the present invention, the framework of the sound attenuator is of the same material as the first resonator plate. In this advantageous embodiment the adverse effects caused by the different heat expansion of different materials can be minimized. When the heat expansion affects the resonator plate and the framework in the same way, the resonant frequency of the attenuator remains constant despite a change in the temperature. In an advantageous embodiment of the invention the material of both the framework and the resonator plate is spring steel plate. A steel plate is typically a more durable solution for the air-conditioning ducts of a paper mill than for example plastic films or aluminium plates. An advantage of stainless steel is among others acid resistance. As the material for the framework and the resonator plate can be used EN 1.4404 class or a corresponding ASTM standard AISI 316 L stainless acid resistant steel plate. Steel in class EN 1.4404 contains at the most 3% molybdenum, which improves the corrosion resistance of the material. The material can however easily be formed and is suitable especially for welding.

In an embodiment of the invention the first resonator plate is manufactured from annealing rolled steel plate. In addition to the first resonator plate also the framework and the second plate can be of annealing rolled steel plate.

In an embodiment of the invention the resonator plate is welded to the framework using continuous laser welding, whereby the seam between them becomes at least essentially continuous. Thus the attenuator member can be made essentially airtight so that the pressure balancing on its inside is done only through the pressure balancing opening. The tight seams also prevent dirt and water from getting inside the attenuator member.

In a device according to the present invention the length of the edges of the attenuator member in the direction of the surface of the first resonator plate is 500-3000 mm and the length of the edges of the attenuator member that are essentially perpendicular to the surface of the first resonator plate is 50-300 mm, preferably 90-210 mm. In an advantageous embodiment the length of the shorter edges in the direction of the surface of the first resonator plate is about 600, 700, 780, 800, 900, 930, 1000 mm or between 500-1100 mm, and the length of the longer edges is about 1000, 1500, 2000 mm or between 800-2200 mm. The advantageous shape and dimensions of the attenuator member enable the substitution of the traditional absorption attenuator member with a plate resonator attenuator member according to the invention. The absorption attenuator members arranged in the sound attenuator frame can for example all be switched to plate resonator attenuator members according to the invention.

In a device according to the present invention the attenuator member comprises one or more attenuator units, wherein the length of the edges essentially in the direction of the surface of the first resonator plate is 200-1500 mm and the length of the edges that are essentially perpendicular to the surface of the first resonator plate is 50-150 mm, preferably 90-110 mm. In an advantageous embodiment the length of the shorter edges of the attenuator unit in the direction of the first resonator plate is 200-400 mm and the length of the longer edges is 500-1100 mm. By selecting advantageous dimensions for the attenuator unit and by welding the resonator plate to a suitable tension, the maximal attenuation, i.e. the resonant frequency, can be set at a suitable frequency range. The resonant frequency is defined mainly according to the depth of the airspace of the attenuator unit and the surface weight of the plate. In this application by resonant frequency is meant the frequency, in practice the frequency range, where the acoustic system vibrates with the maximal amplitude. The resonant frequency corresponds, for the sound attenuator presented in the application, to a frequency range, where the attenuation it produces is at its strongest.

In an advantageous device according to the present invention the second plate, which is comprised in the attenuation member, is a steel plate and is attached to the framework using laser welding. In an advantageous embodiment the material of the second plate is spring steel plate. In an advantageous embodiment the material of the second plate is steel in class EN 1.4404.

In a device according to the present invention the second plate, which is comprised in the attenuator member, is a resonator plate, whereby the distance between the first and the second resonator plate is for example 50-300 mm. In an advantageous device according to the invention the distance between the first and the second resonator plate is for example 50-250 mm.

In a device according to the present invention a third plate is arranged in connection with the framework and between the first and the second resonator plate, substantially parallel to these, which third plate is arranged to divide the attenuator member into two parts, so that attenuator units are formed between the resonator plates, in which units the length of the edges that are essentially perpendicular to the surface of the resonator plates is 50-150 mm. In an advantageous device according to the invention the length of the edges of the attenuator units that are essentially perpendicular to the surface of the resonator plates is 90-110 mm. Such two-sided attenuator members can be arranged for example into the middle part of an air-conditioning duct. The attenuator members, which are in the immediate vicinity of the walls of the sound attenuator frame, can either be one-sided or two-sided. The thickness of the third plate, which is arranged to divide the attenuator member, is preferably 0.5-3 mm, for example 0.8-1.5 mm.

In an advantageous device according to the present invention the thickness of the first or second resonator plate is 0.1-0.5 mm. In some advantageous embodiments of the invention the thickness of the first or second resonator plate is in any of the ranges 0.10-0.19 mm, 0.10-0.25 mm, 0.10-0.35 mm, 0.25-0.35 mm, 0.25-0.5 mm or 0.35-0.5 mm. In an advantageous embodiment of the invention the thickness of both the first and the second resonator plate is 0.25-0.35 mm.

In an advantageous solution according to the present invention the resonant frequency of the sound attenuator is in the frequency range 80-800 Hz. In some advantageous embodiments of the invention the resonant frequency is in any of the ranges 80-200 Hz, 100-350 Hz, 200-450 Hz or 400-800 Hz. In an advantageous embodiment of the invention the resonant frequency of the sound attenuator is in the range 80-315 Hz. The plate resonator can be optimized so that it attenuates especially those frequencies, which are left in the air-conditioning duct after the absorption attenuation.

In an advantageous solution according to the present invention at least one sound attenuator member, based on absorption attenuation, is further arranged inside the attenuator frame. The absorption attenuators, which are traditionally used in the air-conditioning ducts of a paper mill, attenuate 500-4000 Hz frequency components. By arranging traditional absorption attenuators into the frame, in addition to the plate resonator attenuators according to the invention, the frequency range of the maximal attenuation of the sound attenuator can be altered. In this application by absorption attenuator is meant a sound attenuator, the function of which is based on the absorption of acoustic energy into a porous material. In this application absorption attenuator member is used to mean a part of the above-specified absorption attenuator, which comprises porous material.

In a typical manufacturing method for a sound attenuator according to the invention the attenuator member is manufactured by attaching a first resonator plate and a second plate to an essentially rectangular framework, which attenuator member is meant to be placed in the frame of a sound attenuator, which is meant to be arranged for example in connection with an air-conditioning duct of a paper mill. In a typical method according to the invention the first resonator plate is further laser welded in connection to the framework and the pressure is balanced with the aid of a pressure balancing opening arranged in the framework. The first resonator plate is welded to such a tension that the resonant frequency is set between 80-800 Hz.

In a manufacturing method for a sound attenuator according to the invention the resonant frequency of the first resonator plate attached to the framework is set at a desired level by arranging a weight on the plate surface or by painting, using a film, tape or with some other surface treatment.

In a manufacturing method for a sound attenuator according to the invention the resonant frequency of the first resonator plate attached to the framework is determined by measuring the frequency of the sound produced by the resonator plate when struck. When the plate is knocked, it starts to vibrate with a frequency which is inherent to it, i.e. the resonant frequency. The resonant frequency again corresponds to the frequency of the maximal sound attenuation. The sound produced by the knock can be measured for example with a microphone suitable for the purpose.

A typical system according to the invention for attenuating low frequencies for example in air-conditioning ducts of paper mills comprises subsequently at least one sound attenuator based on the absorption method and at least one sound attenuator based on the plate resonator method.

An advantageous system according to the invention comprises at least one sound attenuator according to the invention, based on the plate resonator method.

BRIEF DESCRIPTION OF THE FIGURES

The invention is described in more detail below with reference to the enclosed schematic drawing, in which FIG. 1 An example according to the invention of a sound attenuator frame, which has detachably arranged attenuator members FIG. 2 An example according to the invention of an attenuator member FIG. 3 An example according to the invention of a framework, a first resonator plate, a second plate and an attenuator unit of an attenuator member FIG. 4 An example according to the invention of an attenuator member, which comprises a third plate FIG. 5 A measurement result of a sound attenuator according to the invention FIG. 6 An example according to the invention of a method for manufacturing a sound attenuator for low frequencies FIG. 7 An example according to the invention of a system for attenuating low frequencies for example in the air-conditioning ducts of paper mills

DETAILED DESCRIPTION OF THE EXAMPLES OF THE FIGURES

Figure 1:
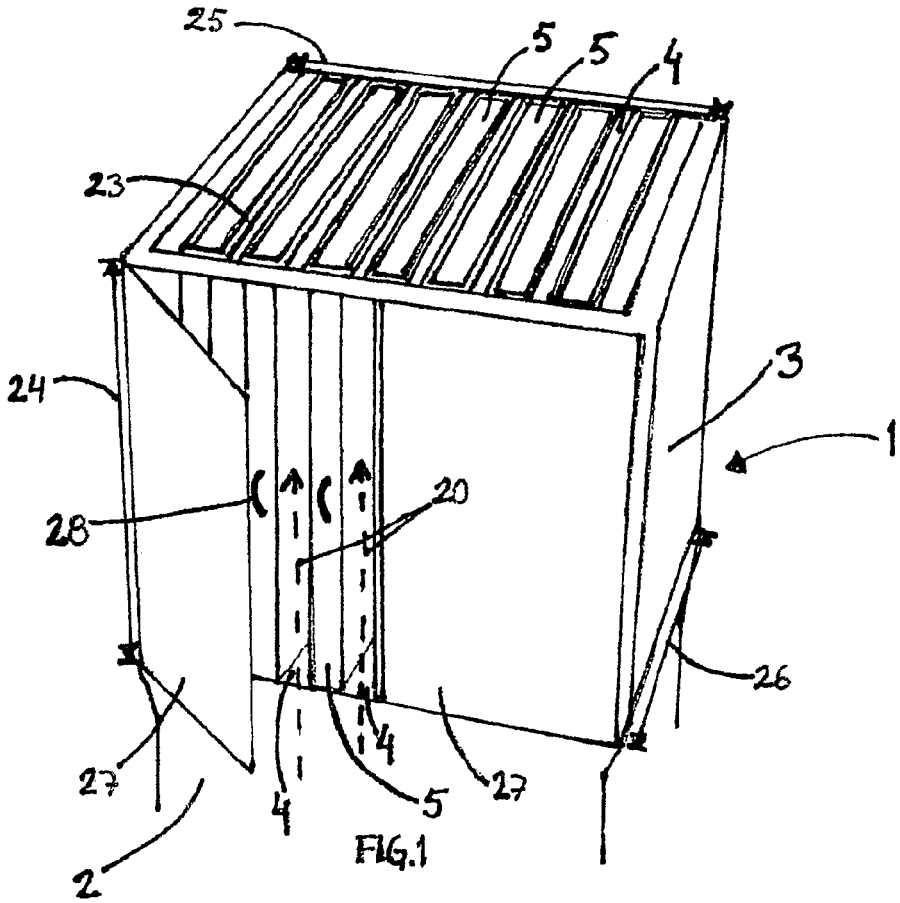

FIG. 1 shows as a schematic view an example of a sound attenuator 1 according to the invention. In the example in the figure the sound attenuator 1 is arranged in connection with an air-conditioning duct 2. The sound attenuator 1 comprises a sound attenuator frame 3, which comprises a flow duct 4. Attenuator members 5 are detachably arranged in connection with the sound attenuator frame 3. In the example according to the figure the attenuator members 5 can be moved with the aid of rail elements 23 arranged between the sound attenuator frame 3 and the attenuator members 5. The height 24 of the sound attenuator frame is about 2000 mm and the width 25 about 2400 mm in the example of the figure. The depth 26 of the sound attenuator frame is about 2200 mm in the example of the figure. Doors 27 can be arranged in the sound attenuator frame and handles 28 in the attenuator members. The main direction 20 of the flow travelling in the air-conditioning duct 2 is marked in the figure.

Figure 2:
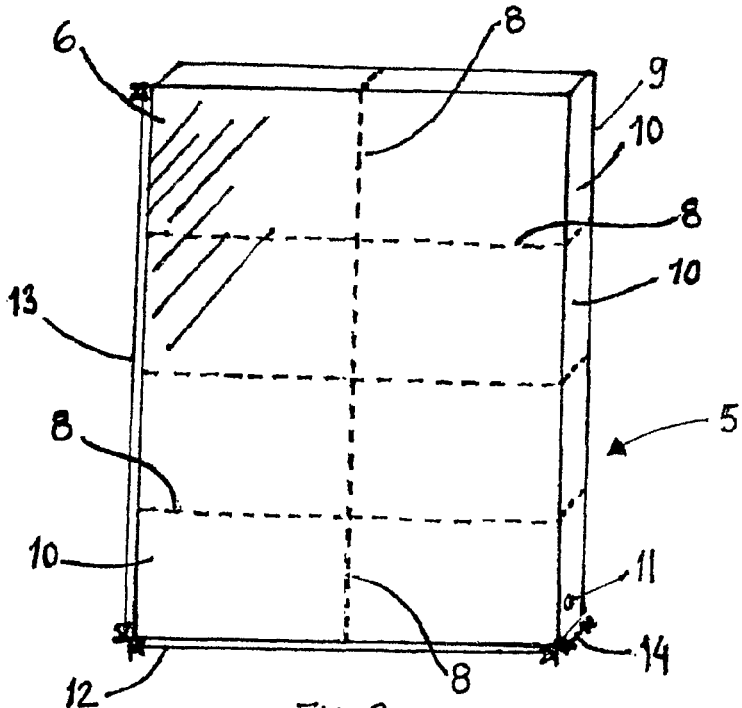

FIG. 2 shows as a schematic view an example according to the invention of an attenuator member 5. The attenuator member comprises a framework 7 and a first resonator plate 6, which is attached by its inner surface to the framework. A second plate 9 is further attached by its inner surface to the framework 7, which second plate can also be a resonator plate. The second plate 9, the framework 7 and the first resonator plate 6 delimit at least one attenuator unit 10, which is essentially in the shape of a rectangular prism. In the example in the figure the edges of the framework 7 are made up of four plates and there is further one vertical and three horizontal plates 8 in the framework, whereby there are 8 attenuator units 10. A pressure balancing opening 11 is further arranged in the framework 7. In the example in the figure the length of the shorter edges 12 of the attenuator member 5 in the direction of the first resonator plate 6 is about 800 mm and the length of the longer edges 13 is about 1000 mm. The length of the edges 14 of the attenuator member 5 in a perpendicular direction to the surface of the first resonator plate 6 is about 100 mm in the example of the figure.

Figure 3:
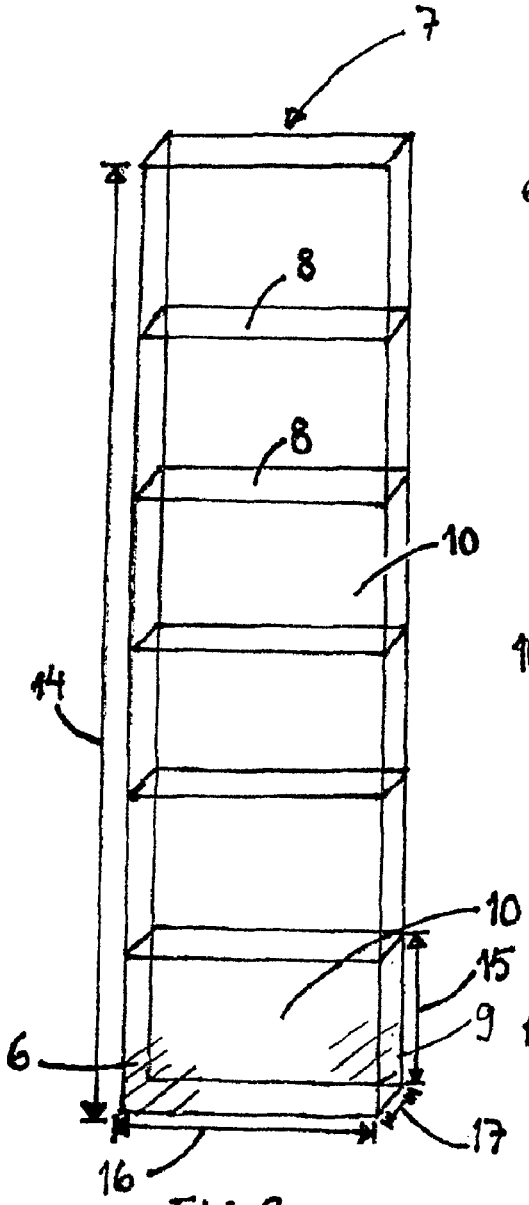

FIG. 3 shows as a schematic view an example of a framework 7 of an attenuator member according to the invention. The framework 7 makes up at least one essential rectangle, which can when needed be divided into parts, whereby several essential rectangles are formed. In the example in the figure the framework 7 is divided into six parts of the same size with the aid of five horizontal essentially rectangular plates 8. In the example in the figure the framework 7 is made up of a plate, which is about 1 mm thick. The framework 7 is divided so that when combined with the first resonator plate 6 and the second plate 9, the framework makes up attenuator units 10 of a desired size. The length of the shorter edges 15 of the attenuator unit 10 essentially in the direction of the surface of the first resonator plate 6 is 200 mm in the example of the figure and the length of the longer edges 16 is 500 mm. The length of the edges 17 essentially in a perpendicular direction to the surface of the first resonator plate 6 is 100 mm in the example of the figure.

Figure 4:
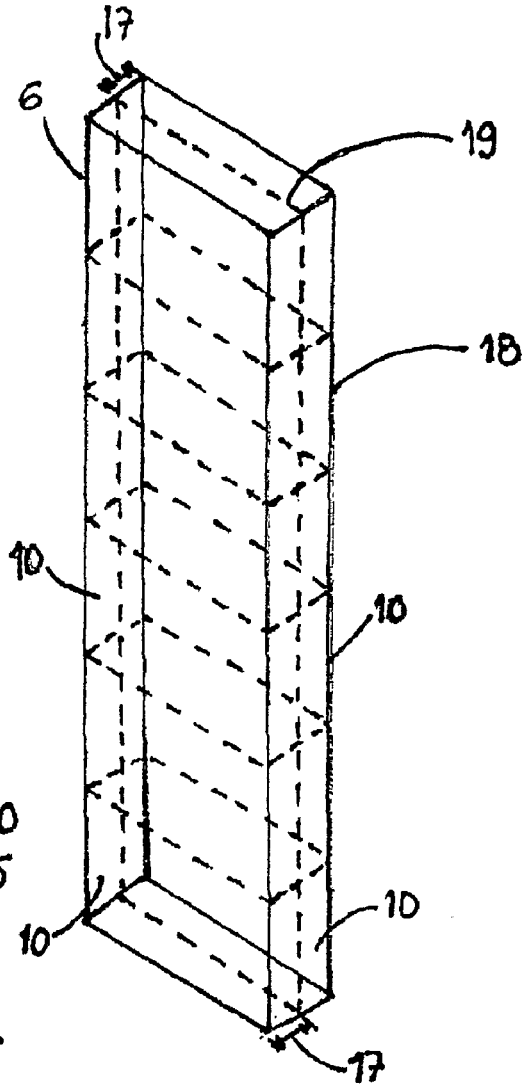

FIG. 4 shows an example according to the invention of an attenuator member 5, where a third plate 19 is arranged in connection with the framework 7 and between the first 6 and the second resonator plate 18, substantially parallel to these, which third plate 19 is arranged to divide the attenuator member 5 into two parts, so that attenuator units 10 are formed between the resonator plates, in which units the length of the edges 17 that are essentially perpendicular to the surface of the resonator plates in the example in the figure is 100 mm. Such two-sided attenuator members 5 can be arranged for example into the middle part of an air-conditioning duct 2. The attenuator members 5, which are in the immediate vicinity of the walls of the sound attenuator frame 3, can either be one-sided or two-sided. The thickness of the third plate 19, arranged to divide the attenuator member 5, is 1 mm in the example of the figure.

Figure 5:
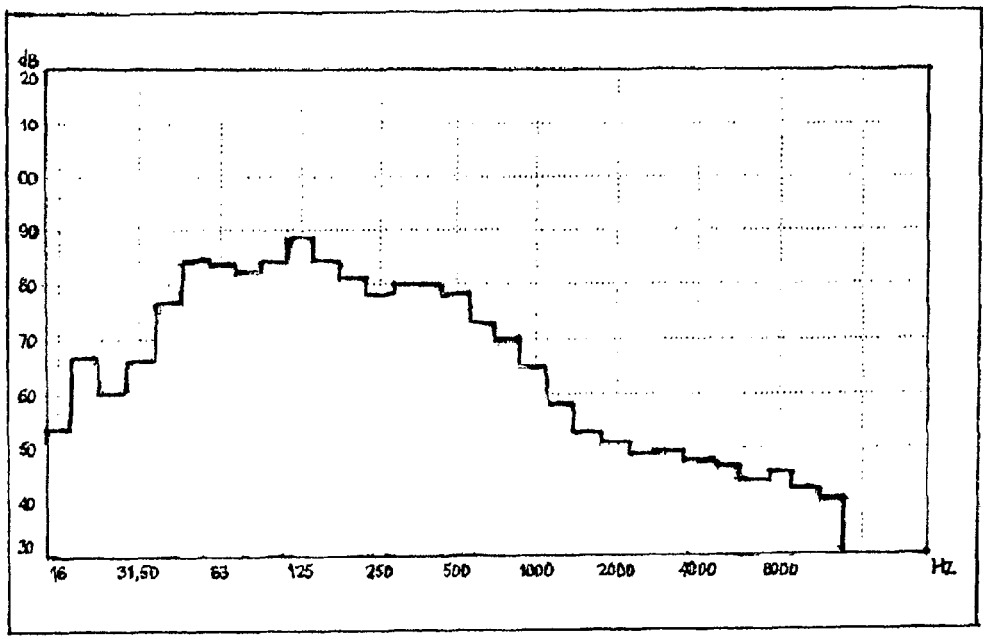

FIG. 5 shows a measuring result, where the frequency of the sound, which the first resonator plate 6 attached to the framework produces when struck, has been measured. On the horizontal axis the frequency is presented in the unit hertz Hz and on the vertical axis the volume in the unit decibel dB. The surface of the first resonator plate 6 is knocked and the volume is measured with a microphone suitable for the purpose. According to the graph drawn from the measurement results, the volume of the sound caused by the knock is at its largest essentially in the frequency range 50-500 Hz. The frequency of the sound produced by the first resonator plate 6 corresponds to the frequency range of the maximal attenuation of the sound attenuator. The maximal attenuation is advantageously in the frequency range 80-800 Hz and for example 80-315 Hz.

Figure 6:
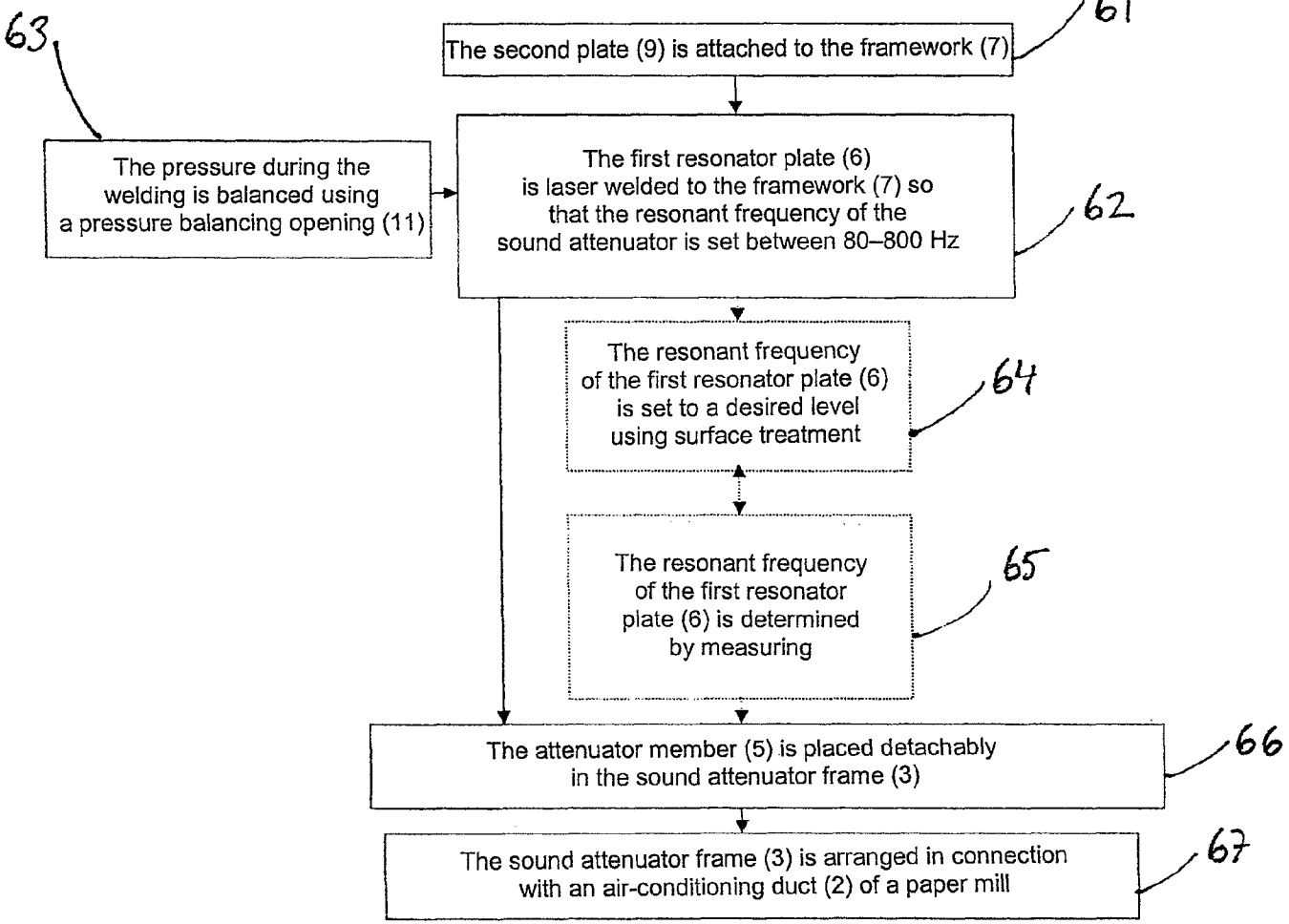

FIG. 6 shows as a flow chart an example of a method according to the invention for manufacturing a sound attenuator for low frequencies. In stage 61 of the exemplary method description a second plate 9 is attached to the framework 7. In method stage 62 the first resonator plate 6 is laser welded to the framework 7 so that the resonant frequency of the sound attenuator is set between 80-800 Hz. The pressure is balanced 63 with the pressure balancing opening 11. In method stage 64 the resonant frequency of the first resonator plate 6 is adjusted to a desired level using surface treatment. In method stage 65 the resonant frequency of the first resonator plate 6 is determined by measuring. Stages 64 and 65 can in the example be left out completely. The method stages 64 and 65 can also be repeated until the pursued measurement result is achieved. In method stage 66 the attenuator member 5 is placed detachably in the sound attenuator frame 3. In the method stage 67 of the example the sound attenuator frame 3 is arranged in connection with an air-conditioning duct of a paper mill.

Figure 7:
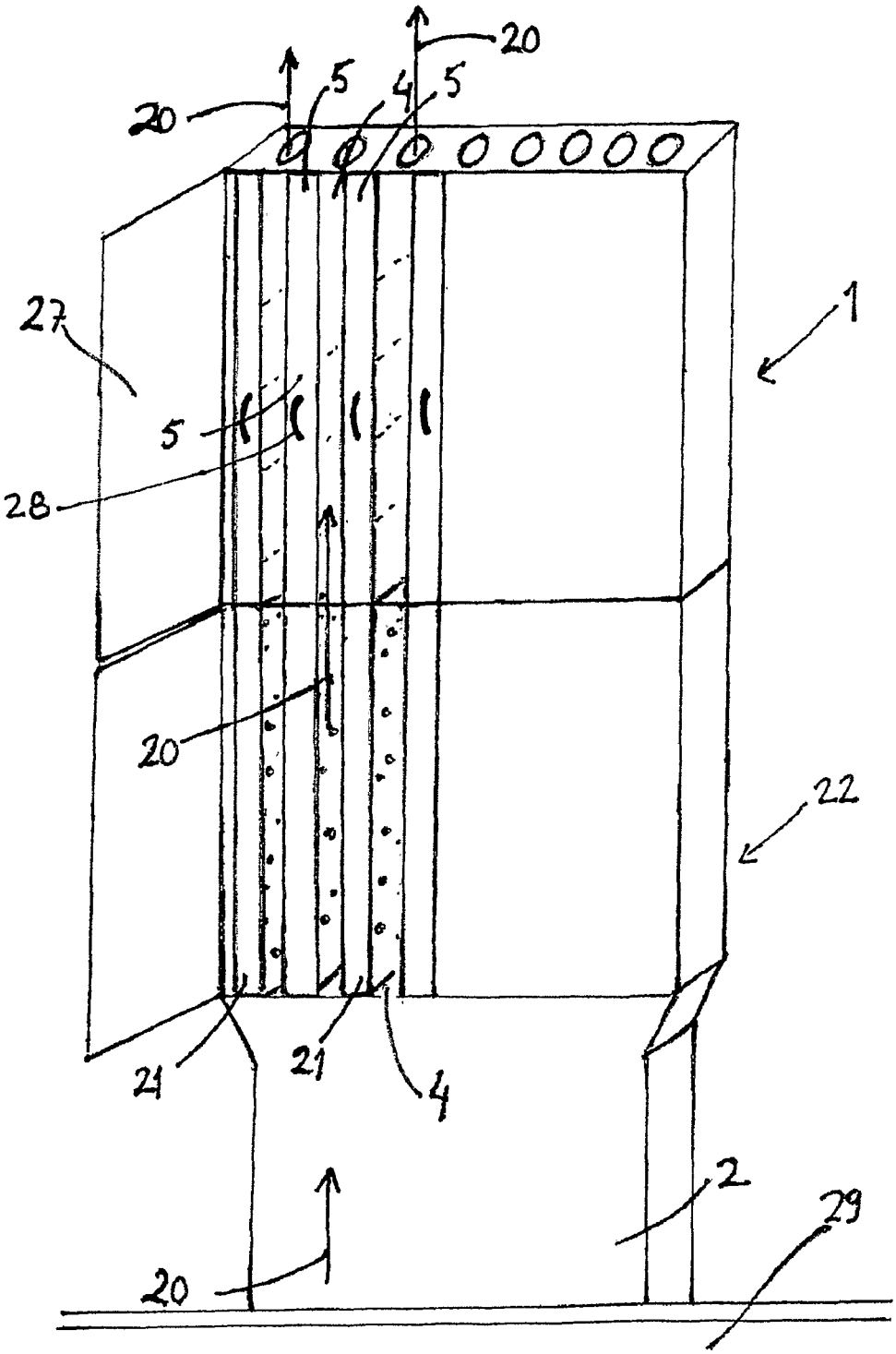

FIG. 7 shows an example of a system according to the invention for attenuating low frequencies for example in air-conditioning ducts of paper mills. In connection with the air-conditioning duct 2 of the paper mill, on the roof 29 of the paper mill, a sound attenuator 22 based on the absorption method is arranged in the example of the figure. In addition to the attenuator based on the absorption method, a sound attenuator 1 based on the plate resonator method is further arranged in connection with the air-conditioning duct in the example in the figure. The main direction 20 of the flow travelling in the air-conditioning duct in the example has been marked in the figure. The attenuators or one of them can be placed also inside the building under the roof 29.

The invention is not meant to be limited to the embodiments shown as examples above, but the aim is to interpret it extensively within the scope of protection defined in the claims presented below.

The invention claimed is:

1. A sound attenuator for low frequencies, comprising:

a sound attenuator frame arrangeable in connection with an air-conditioning duct, and comprising a flow duct; and at least one attenuator member operating according to a plate resonator principle, wherein each said at least one attenuator member comprises:

a first resonator plate having an outer surface arranged to be the inner wall of the flow duct, such that flow through the flow duct is arranged to travel around said outer surface, said first resonator plate being a steel plate, a framework, said first resonator plate having an inner surface attached to said framework, a second plate substantially parallel to the first resonator plate, said second plate having an inner surface attached to said framework, wherein said second plate, said framework and said first resonator plate outline at least one attenuator unit, said first resonator plate is attached to said framework using laser welding, and said framework includes a pressure balancing opening.

2. The sound attenuator of claim 1, wherein said at least one attenuator member is detachably arranged in connection with said sound attenuator frame.

3. The sound attenuator of claim 1, wherein said framework includes at least four substantially rectangular plates.

4. The sound attenuator of claim 1, wherein said framework consists essentially of plates that are perpendicular to said first resonator plate.

5. The sound attenuator of claim 1, wherein both said sound attenuator frame and said at least one attenuator member are substantially rectangular prisms.

6. The sound attenuator of claim 1, wherein each said at least one attenuator unit is substantially a rectangular prism.

7. The sound attenuator of claim 1, wherein said framework is of the same material as said first resonator plate.

8. The sound attenuator of claim 1, wherein said the first resonator plate is attached to said framework using continuous laser welding.

9. The sound attenuator of claim 1, wherein a length of edges of said at least one attenuator member in a direction of the outer surface of said first resonator plate is 500-3000 mm and a length of edges of said at least one attenuator member that are essentially perpendicular to said outer surface of said first resonator plate is 50-300 mm.

10. The sound attenuator of claim 1, wherein a length of edges of said at least one attenuator unit essentially in the direction of said inner surface of said first resonator plate is 200-1500 mm and a length of edges of said at least one attenuator unit that are essentially perpendicular to said inner surface of said first resonator plate is 50-150 mm.

11. The sound attenuator of claim 1, wherein said second plate is a steel plate and is attached to said framework using laser welding.

12. The sound attenuator of claim 11, wherein said second plate is a resonator plate, and a distance between said first resonator plate and said second plate is 100-350 mm.

13. The sound attenuator of claim 12, further comprising a third plate arranged in connection with said framework, essentially parallel to and between first resonator plate and said second plate, said third plate dividing said at least one attenuator member into two parts, so that attenuator units are formed between said first resonator plate and said second plate, a length of edges of the attenuator units that are essentially perpendicular to the inner surface of said first resonator plate is 50-150 mm.

14. The sound attenuator of claim 12, wherein a thickness of at least one of said first resonator plate and said second plate is 0.1-0.5 mm.

15. The sound attenuator of claim 1, wherein a resonant frequency of the sound attenuator is in the frequency range 80-800 Hz.

16. The sound attenuator of claim 1, further comprising at least one sound attenuator member based on absorptive attenuation disposed inside said sound attenuator frame.

17. A method for manufacturing a sound attenuator for low frequencies having an attenuator member insertable into a sound attenuator frame, the method comprising manufacturing the attenuator member by:

attaching a first resonator plate to an essentially rectangular framework a first resonator plate using laser welding, wherein the first resonator plate is laser welded to such a tension that the resonant frequency of the sound attenuator is set between 80-800 Hz;

attaching a second plate to the essentially rectangular framework; and arranging a pressure balancing opening in the framework to balance pressure.

18. The method of claim 17, further comprising setting a resonant frequency of the first resonator plate attached to the framework to a desired level using weights, painting, foil, tape or another surface treatment.

19. The method of claim 17, further comprising determining a resonant frequency of the first resonator plate attached to the framework by measuring a frequency of a sound produced by the first resonator plate when struck.

20. A system for attenuating low frequencies in an air-conditioning duct, comprising:

at least one first sound attenuator based on an absorption method; and at least one second sound attenuator based on a plate resonator method, wherein said at least one sound attenuator based on the plate resonator method comprises:

a sound attenuator frame arrangeable in connection with an air-conditioning duct, and comprising a flow duct; and at least one attenuator member operating according to a plate resonator principle, wherein each said at least one attenuator member comprises:

a first resonator plate having an outer surface arranged to be the inner wall of the flow duct, such that flow through the flow duct is arranged to travel around said outer surface, said first resonator plate being a steel plate, a framework, said first resonator plate having an inner surface attached to said framework, a second plate substantially parallel to the first resonator plate, said second plate having an inner surface attached to said framework, wherein said second plate, said framework and said first resonator plate outline at least one attenuator unit, said first resonator plate is attached to said framework using laser welding; and said framework includes a pressure balancing opening.

21. The sound attenuator of claim 1, wherein said sound attenuator frame is configured to be inserted in an air conditioning duct so that a flow travelling in the air conditioning duct passes through the sound attenuator.

22. The sound attenuator of claim 12, wherein a thickness of at least one of said first resonator plate and said second plate is 0.25-0.35 mm.

23. The sound attenuator of claim 1, wherein a resonant frequency of the sound attenuator is in the frequency range 80-315 Hz.

* * * * *